US005207186A

United States Patent [19]

Okita

[11] Patent Number: 5,207,186

[45] Date of Patent: May 4, 1993

[54] ARRANGEMENT FOR MOUNTING AN ELECTRONIC CONTROL UNIT ON AN ENGINE

[75] Inventor: Ryozo Okita, Hamamatsu, Japan

[73] Assignee: Sanshin Kogyo Kabushiki Kaisha, Hamamatsu, Japan

[21] Appl. No.: 804,790

[22] Filed: Dec. 9, 1991

[30] Foreign Application Priority Data

Jan. 28, 1991 [JP] Japan ..... 3-25005

[51] Int. Cl.[5] ..... F01P 1/06

[52] U.S. Cl. ..... 123/41.31; 123/198 E

[58] Field of Search ..... 123/41.31, 195 C, 198 R, 123/198 E

[56] References Cited

U.S. PATENT DOCUMENTS 3,996,914 12/1976 Crall et al. ..... 123/198 R
4,561,396 12/1985 Sakamoto et al. ..... 123/198 E
4,719,891 1/1988 Porth et al. ..... 123/198 E

*Primary Examiner*—Noah P. Kamen
*Attorney, Agent, or Firm*—Ernest A. Beutler

[57] ABSTRACT

An arrangement for mounting an electronic control unit on an internal combustion engine which protects the unit from structural and thermal damage.

11 Claims, 4 Drawing Sheets

ARRANGEMENT FOR MOUNTING AN ELECTRONIC CONTROL UNIT ON AN ENGINE

BACKGROUND OF THE INVENTION

This invention relates to an arrangement for mounting an electronic control unit on an internal combustion engine, and more particularly to an improved, simple structural arrangement for mounting an electronic control unit on an internal combustion engine which protects the unit from thermal and structural damage.

It is well known that a wide variety of internal combustion engines are now provided with electronic ignition control. The use of electronic circuitry permits a wider adjustment of ignition timing to suit a variety of different operating conditions. Electronic control has also been used for fuel feed and to adjust the trim of an outboard drive unit. The electronic circuitry for controlling the ignition timing, fuel feed or trim angle has typically been accommodated within a casing that is mounted on the cylinder head or on the cylinder block of the engine. Although such an arrangement has advantages, there are some disadvantages associated with it as well. For example, when the electronic control unit is mounted on the engine block or cylinder head, the internal circuitry must be protected from the high temperatures to which such engine parts are subjected during operation in order to protect the unit against thermal damage.

It is, therefore, a principal object of this invention to provide a simple yet effective structure and arrangement for mounting an electronic control unit on an engine which protects the unit from thermal damage.

It is another object of this invention to provide an improved structure and arrangement for mounting an electronic control unit on an engine wherein the unit is protected from structural damage resulting from engine vibration.

SUMMARY OF THE INVENTION

This invention is adapted to be embodied in an electronic control unit for an internal combustion engine having an induction system and an air inlet device defining at least one air intake passage through which air is supplied to the induction system of the engine. The electronic control unit comprises an outer casing that is mounted in proximity to the air intake passage and a plurality of electronic parts mounted in the outer casing so that they are protected from thermal damage.

DETAILED DESCRIPTION OF THE PREFERRED EMBODIMENTS OF THE INVENTION

Figure 1:
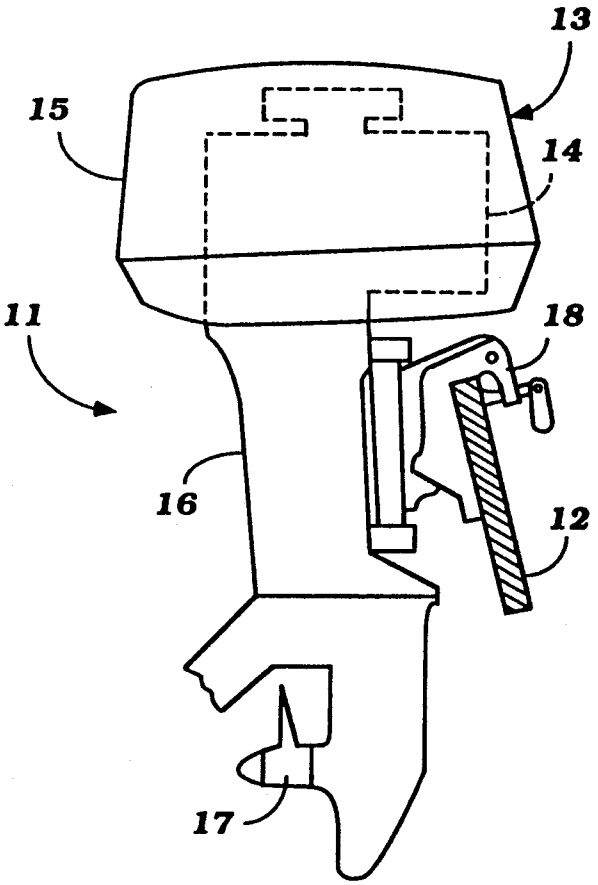
FIG. 1 is a side elevational view of an outboard motor illustrating the environment in which the invention may be practiced.

Referring first to FIG. 1, an outboard drive unit in the form of an outboard motor constructed in accordance with an embodiment of the invention and identified generally by the reference numeral 11 is mounted on a transom 12 of a hull of an associated watercraft. The outboard motor 11 is comprised of a power head 13 that includes an internal combustion engine 14 which may be of any known type and which is enclosed within a protective cowling 15. The engine 14 has an output shaft (not shown) that drives a drive shaft journaled for rotation within a drive shaft housing 16. The drive shaft, in turn, drives a propeller 17 of a lower unit through a conventional forward, neutral, reverse transmission (not shown).

A steering shaft is affixed to the drive shaft housing 16 and is journaled within a swivel bracket for steering of the outboard motor 11 about a generally vertically extending steering axis. The swivel bracket is, in turn, connected for pivotal movement to a clamp bracket 18 by means of a pivot pin for tilt and trim adjustment of the outboard motor 11. A clamping mechanism is carried by the clamp bracket 18 for affixing the outboard motor 11 to the transom 12 of the watercraft.

Figure 2:
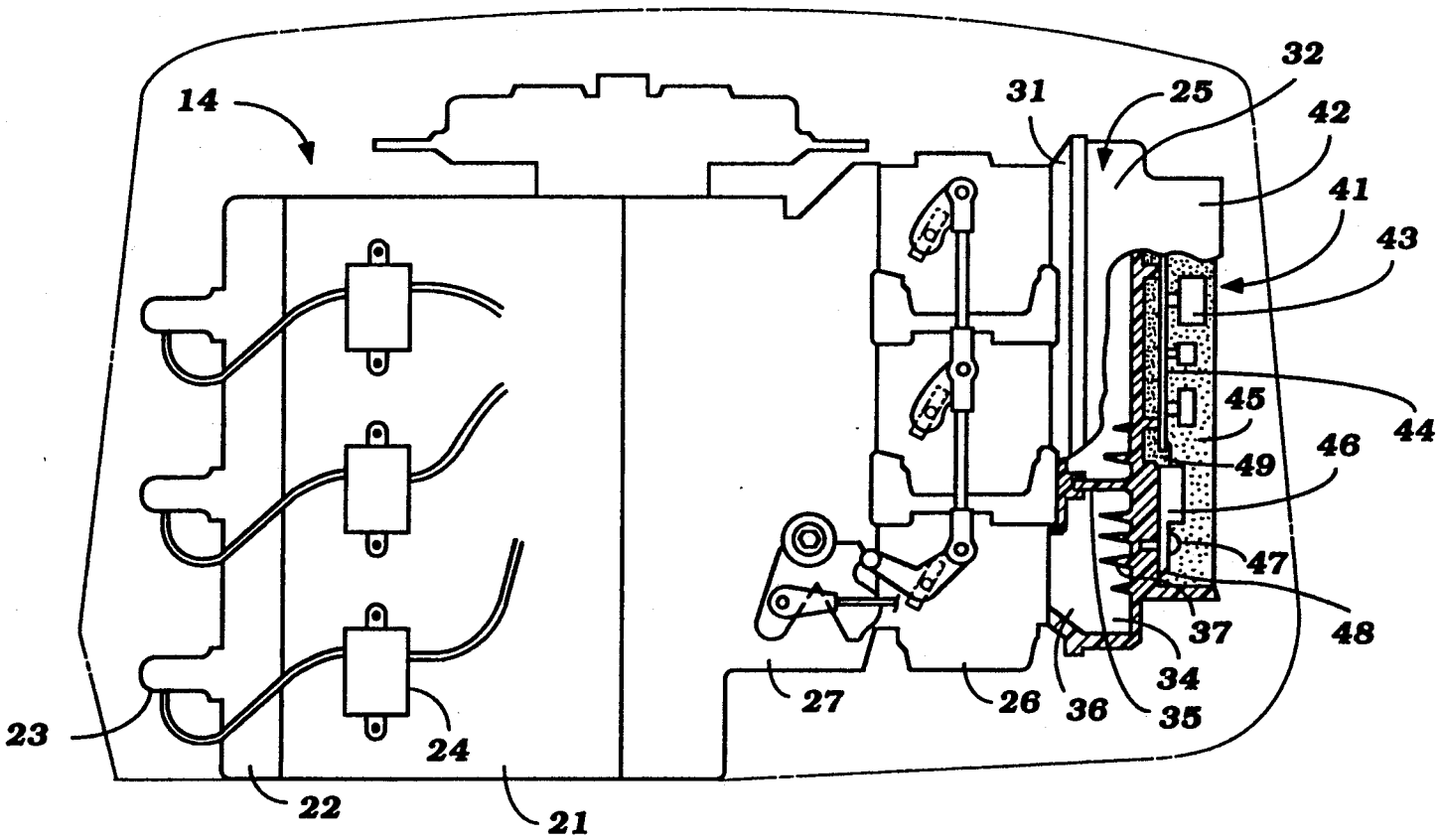
FIG. 2 is an enlarged side elevational view of the power head of the outboard motor constructed in accordance with a first embodiment of the invention with the protective cowling shown in phantom so as to more clearly illustrate the construction and the arrangement of the first embodiment of the invention.

Referring now in detail to FIG. 2, it will be noted that the engine 14, in the illustrated embodiment, is of the in-line, three cylinder, two cycle type and is comprised of a cylinder block 21 to which a cylinder head 22 is affixed in a known manner. There are provided individual spark plugs 23 for each cylinder of the engine 14, these being mounted in the cylinder head 22 in a known manner. The spark plugs 23 are fired by means of individual spark coils 24 that are energized by an ignition circuit which may be contained within a control box (not shown). The firing power for the spark plugs 23 is derived from a magneto generator which includes a flywheel magneto that is affixed to the engine output shaft for rotation with it by a key and a nut.

The engine 14 is also provided with an induction system that includes an air inlet device, indicated generally by the reference numeral 25, that draws air from the interior of the protective cowlinq 15 and delivers it to a plurality of carburetors 26. The carburetors 26 each have a respective throttle valve that is interconnected with the others by means of a linkage system that is operated from a single lever control by means including a throttle control link. The carburetors 26 supply a fuel/air charge to the engine 14 and more specifically to the crank chambers defined in its crankcase 27 through an intake manifold.

Figure 3:
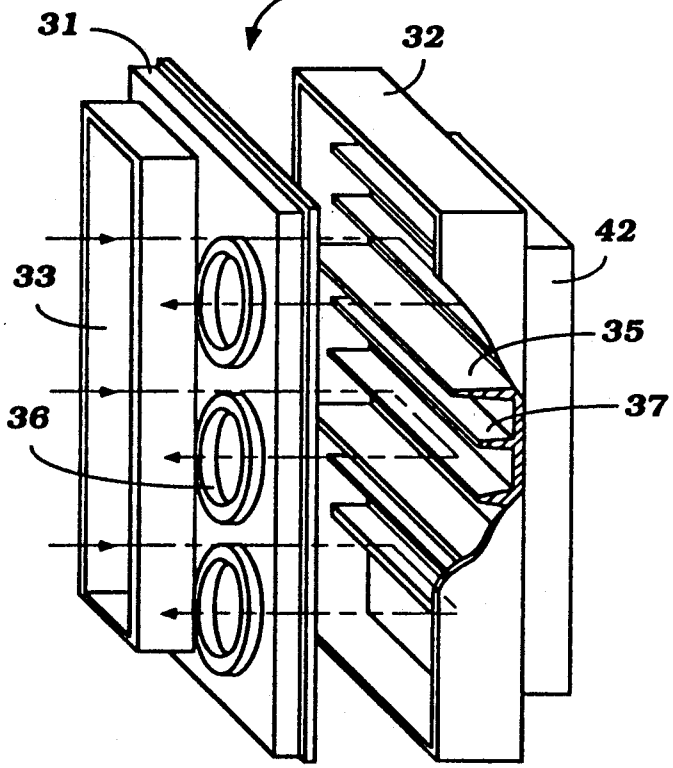
FIG. 3 is a perspective view of the components of the air inlet device of the engine and with the outer casing of the electronic control unit formed integrally with the cover of the air inlet device.

Referring now to FIG. 3, in addition to FIG. 2, the air inlet device 25 comprises a base portion 31 secured to the carburetors 26 and a cover piece 32 that is mounted on the base 31. The base 31 has an air inlet port 33 through which air is inducted from the inside of the cowling 15 into the air inlet device 25. Once inducted through the air inlet port 33, the air then continues to flow through a plurality of air intake passages 34 which are formed in the air inlet device 25 and which are defined in part by a plurality of generally horizontally extending partition plates 35 which are formed on the inner wall of the cover 32 and corresponding air communication ports 36 formed in the base 31 and each of which is in communication with one of the carburetors 26. Also formed on the inner wall of the cover 32 are a plurality of fins 37 which are parallel to and positioned between the partition plates 35 and which protrude into the air passages 34. The partition plates 35 and fins 37 are arranged, as shown in FIG. 3, so that the air intake passages 34 in the air inlet device 25 and the air flowing through them from the inlet port 33 to the communication ports 36 are in parallel with each other, as illustrated by the air flow arrows in FIG. 3.

In accordance with the invention, an electronic control unit, identified generally by the reference numeral 41, is provided in close proximity to the air inlet device 25, and more particularly in close proximity to a segment of the air passages 34. The electronic control unit 41 includes an outer casing 42 which, in the illustrated embodiment, is formed integrally with the cover 32 on its outer surface. It should be noted, however, that the electronic control unit 41 may instead be a separate piece affixed to, or mounted in close proximity to, the air inlet device 25. The electronic control unit 41 serves to electronically control one or more features of the engine 14 and/or outboard motor 11, such as ignition timing, fuel delivery, trim angle or the like.

To this end, there is contained within the outer casing 42 various electronic components 43 such as semi-conductors, resistors, capacitors and the like, which are mounted on a printed circuit board 44, as shown in FIG. 2. The electronic components 43 and printed circuit board 44 are held in place within the casing 42 by means of a resinous potting compound 45. Also contained within the outer casing 42 are electronic elements 46, such as a power transistor, which require heat radiation for effective operation. Such elements 46 are affixed directly to the wall of the casing 42 that is formed with the outer wall of the cover 32 by means of screws 47 which are inserted through heat radiation tabs 48 extending from the elements 46. These electronic elements 46 are connected to the circuit board 44 by lead wires 49.

With this structural arrangement, the air inlet device 25 is maintained at about ambient temperature and tends to be cooled by vaporization of spitting fuel from the carburetors 26, and thus heat generated by the electronic control unit 41 tends to be transferred away from the electrical components 43 and circuit board 44 to effectively protect them from thermal influence. The relatively large surface area of the cover 32 which is further increased by the partition plates 35 and fins 37 increase the amount of convection and radiation available for heat transfer.

Moreover, since the air inlet device 25 is located remotely from the cylinder block 21 and cylinder head 22 in which the combustion chambers and exhaust gas passages are formed, the electronic control unit 41, which is in close contact with the air inlet device 25, is very well suited for protecting its internal components from thermal damage. Also, by locating the air inlet device 25/electronic control unit 41 assembly remotely from the spark plugs 23 and spark coils 24, interference from noise and extraneous unwanted signals is greatly reduced, and hence it is possible to simplify or omit a design for protecting the electronic control unit 41 from unwanted noise.

Figure 4:
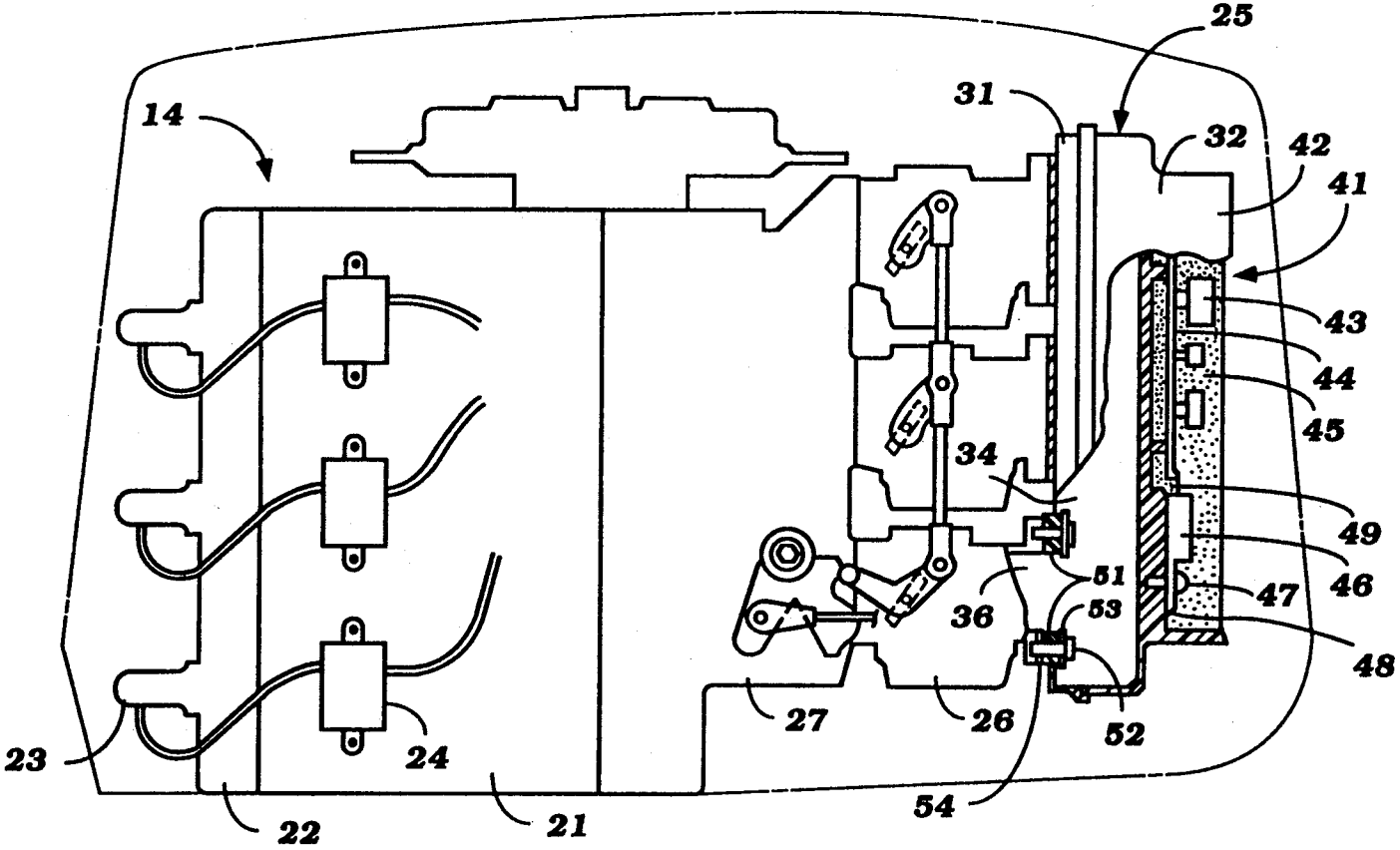
FIG. 4 is an enlarged side elevational view of the power head of the outboard motor constructed in accordance with a second embodiment of the invention wherein the protective cowling is shown in phantom so as to more clearly illustrate the construction and arrangement of this second embodiment.

FIG. 4 illustrates an alternative structural arrangement for mounting an electronic control unit on an internal combustion engine constructed in accordance with a second embodiment of the invention. The structure and arrangement of this second embodiment is generally similar to that described in connection with the first embodiment. For that reason, components of this second embodiment which are the same as components of the first embodiment are identified by the same reference numerals and will not be described again, except insofar as is necessary to understand the construction and operation of this second embodiment.

This second embodiment illustrated in FIG. 4 differs from the first embodiment in that a rubber mount 51 is provided between the base portion 31 of the air inlet device 25 and the carburetors 26 to insulate the device 25 from engine vibration. The rubber mount 51 is held in place by means of an assembly including a bolt 52 that is screwed into a flange portion of the carburetors 26, a washer 53 and a collar 54 to hold the bolt 52 in place. With this construction, much of the vibration from the engine 14 is absorbed by the rubber mount 51 and thus is not readily transmitted to the electronic control unit 41. As a result, the printed circuit board 44 is protected against cracking and the lead wires 49 connected to the electric elements 46 will not easily break. However, since the rubber mount 51 is not positioned between the air inlet device 25 and the electronic control unit 41, heat transfer between the unit 41 and the device 25 and heat dissipation from the internal electronic components 43 is not obstructed.

Figure 5:
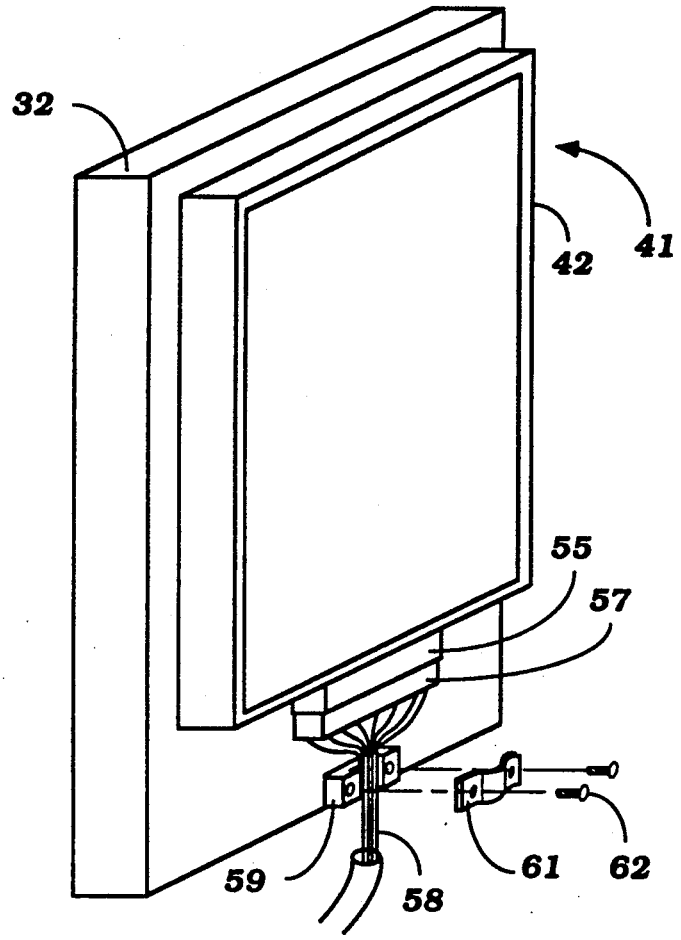
FIG. 5 shows the outer casing of the electronic control unit formed with the cover of the air inlet device and the connection between the electronic control unit and a wire harness.
Figure 6:
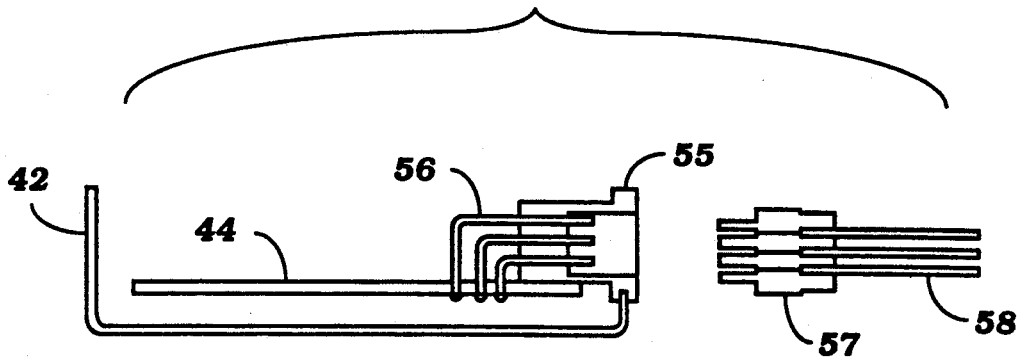
FIG. 6 is a side view of the electronic control unit broken away to show the internal circuit board and a direct connection between the outer casing and the circuit board.

Referring now to the remaining FIGS. 5 and 6, it will be seen that the printed circuit board 44 is secured to the outer casing 42 by a connector piece 55 which has wire pins 56 that are soldered or welded to the circuit board 44. Connector piece 55 is adapted to receive another connector piece 57 which has a wire harness 58 attached to transmit electrical signals to and from the circuit board 44. The wire harness 58 is held in place by a crimp assembly which includes a crimp seat 59 affixed to the air inlet cover 32 and an outer crimp piece 61 which is attached to the crimp seat 59 by bolts 62.

Thus with the rubber mount 51 positioned between the air inlet device 25 and the carburetors 26, the vibration frequency of the outer casing 42 will nearly coincide with that of the wire harness but will differ from the vibration frequency of the engine block 21. As a result, any vibration of the wire harness 58 caused by the vibration of the engine 14 during operation is not conducted through the connector pieces 55 and 57 and the pins 56 so as to prevent the pins 56 and lead wires 49 from breaking.

It should be readily apparent from the foregoing description that a very effective structural arrangement is provided for mounting an electronic control unit on an internal combustion engine which protects the unit from both structural and thermal damage. Although various embodiments of the invention have been illustrated and described, various changes and modifications may be made without departing from the spirit and scope of the invention, as defined by the appended claims. For example, the electronic control unit need not be mounted on, or formed integrally with, the air inlet device 25, but may be positioned in other locations adjacent to the air passages 34 through the air inlet device 25.

I claim:

1. An electronic control unit for an internal combustion engine having an induction system and an air inlet device defining a plurality of air intake passages through which air is supplied to the induction system and comprising at least one fin fixed in parallel with the flow of air through the air intake passages and at least one partition wall which cooperates in defining the air intake passages and which cooperates in dividing adjacent air intake passages on either side of the partition wall, said electronic control unit comprising an outer casing mounted in proximity to the air intake passage and a plurality of electronic parts mounted in said outer casing.

2. An electronic control unit as recited in claim 1, wherein said outer casing is mounted on said air inlet device.

3. An electronic control unit as recited in claim 1, wherein said air inlet device comprises an air inlet port through which air is inducted into the air intake passages and at least one communication port communicating the air intake passages with said induction system.

4. An electronic control unit as recited in claim 1, wherein said air inlet device comprises an air inlet port through which air is inducted into he air intake passages and a plurality of communication ports for communicating the air intake passages with said induction system.

5. An electronic control unit as recited in claim 4, wherein said air inlet device comprises a plurality of generally horizontally extending partition walls defining said plurality of air intake passages and arranged so that the plurality of air intake passages are in parallel with each other.

6. An electronic control unit as recited in claim 5, wherein said air inlet device comprises at least one generally horizontally extending fin positioned between the partition walls and in parallel with the flow of air through the air intake passages.

7. An electronic control unit as recited in claim 1, wherein said outer casing is formed integrally with said air inlet device.

8. An electronic control unit as recited in claim 7, wherein said air inlet device comprises an air inlet port through which air is inducted into the air intake passages and at least one communication port communicating the air intake passages with said induction system.

9. An electronic control unit as recited in claim 8, wherein said air inlet device comprises an air inlet port through which air is inducted into the air intake passages and a plurality of communication ports for communicating the air intake passages with said induction system.

10. An electronic control unit as recited in claim 9, wherein said air inlet device comprises a plurality of generally horizontally extending partition walls defining said plurality of air intake passages and arranged so that the plurality of air intake passages are in parallel with each other.

11. An electronic control unit as recited in claim 10, wherein said air inlet device comprises at least one generally horizontally extending fin positioned between the partition walls and in parallel with the flow of air through the air intake passages.

* * * * *